US008146253B2

(12) United States Patent
Sato et al.

(10) Patent No.: US 8,146,253 B2
(45) Date of Patent: Apr. 3, 2012

(54) INNER CUTTER OF ELECTRIC SHAVER AND RECIPROCATING ELECTRIC SHAVER

(75) Inventors: Masaaki Sato, Hikone (JP); Takeshi Shiba, Hikone (JP); Jyuzaemon Iwasaki, Nagahama (JP); Shinji Fujimoto, Neyagawa (JP); Shunsuke Komori, Hikone (JP)

(73) Assignee: Panasonic Corporation, Osaka (JP)

( * ) Notice: Subject to any disclaimer, the term of this patent is extended or adjusted under 35 U.S.C. 154(b) by 420 days.

(21) Appl. No.: 11/738,056

(22) Filed: Apr. 20, 2007

(65) Prior Publication Data

US 2007/0245565 A1 Oct. 25, 2007

(30) Foreign Application Priority Data

Apr. 25, 2006 (JP) ..... 2006-121232

(51) Int. Cl.
*B26B 19/04* (2006.01)

(52) U.S. Cl. ..... 30/43.92

(58) Field of Classification Search ..... 30/43.5–46
See application file for complete search history.

(56) References Cited

U.S. PATENT DOCUMENTS

| | | | | |
|---|---|---|---|---|
| 2,318,351 | A * | 5/1943 | Alexay | 30/43.91 |
| 3,088,205 | A * | 5/1963 | Ellis | 30/34.05 |
| 3,456,341 | A * | 7/1969 | Loner et al. | 30/34.1 |
| 3,810,306 | A * | 5/1974 | Locke | 30/43.92 |
| 4,240,200 | A * | 12/1980 | Bukoschek | 30/43.92 |
| 4,261,101 | A * | 4/1981 | Tietjens et al. | 30/43.92 |
| 4,283,848 | A | 8/1981 | Messinger et al. | |
| 4,424,628 | A * | 1/1984 | Groothuis et al. | 30/43.92 |
| 4,510,687 | A | 4/1985 | Groothuis et al. | |
| 4,815,209 | A | 3/1989 | Benoist et al. | |
| 5,131,148 | A * | 7/1992 | Wahl | 30/43.92 |
| 5,909,929 | A * | 6/1999 | Chen | 30/43.92 |
| 6,098,289 | A * | 8/2000 | Wetzel et al. | 30/43.92 |
| 6,219,920 | B1 * | 4/2001 | Klein | 30/43.92 |
| 7,017,270 | B2 | 3/2006 | Shiba et al. | |
| 7,127,818 | B2 | 10/2006 | Sato et al. | |
| 2006/0137187 | A1 | 6/2006 | Fukutani et al. | |

FOREIGN PATENT DOCUMENTS

| | | | |
|---|---|---|---|
| AT | 255283 | | 6/1967 |
| EP | 0083952 | A1 * | 1/1983 |
| EP | 0083952 | | 7/1983 |
| GB | 1202247 | A | 8/1970 |
| JP | 2004-016520 | | 1/2004 |
| JP | 2004-016520 | A | 1/2004 |

(Continued)

OTHER PUBLICATIONS

English Language Abstract of JP 2004-016520.

(Continued)

*Primary Examiner* — Edward Landrum
(74) *Attorney, Agent, or Firm* — Greenblum & Bernstein P.L.C.

(57) ABSTRACT

An inner cutter of an electric shaver that cuts hairs by sliding along an inner surface of an outer cutter includes a base portion that is connected to a driving unit, a plurality of cutting pieces that are formed in a U-shape and whose both ends in the longitudinal direction are fixed to the base portion, and a plate member whose one end is fixed to the base portion and the other end is connected to the cutting piece. The plate member is elastically deformed corresponding to elastic deformation of the cutting piece.

13 Claims, 12 Drawing Sheets

FOREIGN PATENT DOCUMENTS

| | | | |
|---|---|---|---|
| RU | 2170660 | C1 | 7/2001 |
| SU | 821127 | | 4/1981 |
| SU | 1012791 | A3 | 4/1983 |
| WO | 99/10142 | | 3/1999 |

OTHER PUBLICATIONS

English language Abstract of JP 2004-016520 A.
English language partial translation of SU 821127 A1.

* cited by examiner

INNER CUTTER OF ELECTRIC SHAVER AND RECIPROCATING ELECTRIC SHAVER

CROSS REFERENCE TO RELATED APPLICATION

This application is based upon and claims the benefit of priority from prior Japanese Patent Application P2006-121232, filed on Apr. 25, 2006; the entire contents of which are incorporated by reference herein.

BACKGROUND OF THE INVENTION

1. Field of the Invention

The present invention relates to an inner cutter of an electric shaver and a reciprocating electric shaver including the same.

2. Description of the Related Art

Conventionally, there have been known reciprocating shavers that include an outer cutter having cutter holes and inner cutters having a plurality of U-shaped cutting pieces and sliding inside the outer cutter, and that cut hairs entered through the cutter holes with the cutting pieces of the inner cutter and the outer cutter by reciprocating the inner cutters (for example, see Japanese Patent Laid-Open Publication No. 2004-16520).

In such reciprocating shavers, shaving sound occurs at the time of cutting hairs. Users judge the shaving state from this shaving sound. This shaving sound is generated by vibration of the cutting pieces caused when the cutting pieces of the inner cutter recover to the original form when hairs are cut, from a bent state caused by the hairs that have entered through the cutter holes. In the conventional electric shavers, however, there is a problem that this shaving sound is small.

Japanese Patent Laid-Open Publication No. 2004-16520 discloses a technique of amplifying this shaving sound by providing, inside cutting pieces of inner cutters, a plate member to cause aerial vibration to increase vibrated air. Moreover, the publication also discloses a technique of amplifying the shaving sound by providing a protruding portion in a joint member that supports both ends of the cutting pieces of the inner cutters to increase vibrated air.

However, in these techniques, the plate member or the protruding portion is supported in the cantilever structure, and therefore, the plate member can make different vibration (movement) from that of the cutting pieces. Thus, there is a problem that amplification of the shaving sound is limited.

SUMMARY OF THE INVENTION

It is an object of the present invention to surely amplify shaving sound of an electric shaver.

A first aspect of the present invention provides an inner cutter of an electric shaver that cuts hairs by sliding along an inner surface of an outer cutter having cutting holes through which the hairs enter, comprising: a base portion that is connected to a driving unit of the electric shaver; a plurality of cutting pieces that are formed thin and long in a U-shape such that an outer surface contacts the inner surface of the outer cutter, and that are fixed to the base portion at both ends in a longitudinal direction thereof; and a plate member, one end of which is fixed to the base portion and another end of which is connected to the cutting piece, and that is elastically deformed corresponding to elastic deformation of the cutting piece.

A second aspect of the present invention provides the inner cutter of an electric shaver according to the first aspect, wherein the other end of the plate member and a curvature top portion of the cutting piece overlap with each other in a direction of sliding.

A third aspect of the present invention provides the inner cutter of an electric shaver according to the first or second aspect, wherein rigidity of the plate member is lower than rigidity of the cutting piece.

A fourth aspect of the present invention provides the inner cutter of an electric shaver according to any one of the first to third aspects, wherein the plate member is formed such that thickness at the one end is thinner than thickness at the other end.

A fifth aspect of the present invention provides the inner cutter of an electric shaver according to any one of the first to fourth aspects, wherein the plate member and the cutting piece are configured to enable relative movement along an inner-outer direction of the curvature top portion of the cutting piece.

A sixth aspect of the present invention provides the inner cutter of an electric shaver according to any one of the first to fifth aspects, wherein the plate member and the cutting piece are connected by engaging a groove and the cutting piece, the groove formed by pressing the plate member relative to the cutting piece while heating the other end of the plate member.

A seventh aspect of the present invention provides the inner cutter of an electric shaver according to any one of the first to fifth aspects, wherein the plate member and the cutting piece are connected by pressing the other end of the plate member to the cutting piece by a restoring force of the plate member that has been bent.

An eighth aspect of the present invention provides the inner cutter of an electric shaver according to any one of the first to fifth aspects, wherein the plate member and the cutting piece are connected by engaging an engaging portion and the cutting piece, the engaging portion formed in advance in the plate member.

A ninth aspect of the present invention provides the inner cutter of an electric shaver according to any one of the first to fifth aspects, wherein the plate member includes a groove at the other end, the groove with which the cutting piece is engaged, and a space is provided between a bottom surface of the groove and the cutting piece.

A tenth aspect of the present invention provides the inner cutter of an electric shaver according to any one of the first to ninth aspects, wherein the plate member is formed with resin.

An eleventh aspect of the present invention provides the inner cutter of an electric shaver according to the second aspect, wherein the plate member is connected to an inner circumference portion of the curvature top portion of the cutting piece, and the cutting piece is formed such that thickness in the direction of sliding at an outer circumference portion of the curvature top portion is thicker than thickness in the direction of sliding at the inner circumference portion of the curvature top portion.

A twelfth aspect of the present invention provides the inner cutter of an electric shaver according to any one of the first to eleventh aspects, wherein a position at which the one end of the plate member and the base portion are fixed and a position at which the other end of the plate member and the cutting piece are connected are shifted in the direction of sliding.

A reciprocating electric shaver according to the present invention comprises: an outer cutter that includes cutting holes through which hairs enter; the inner cutter of an electric shaver according to any one of the first to twelfth aspect that slides on an inner surface of the outer cutter to cut the hairs with the outer cutter; and a driving unit that reciprocates the inner cutter.

DETAILED DESCRIPTION OF THE PREFERRED EMBODIMENTS

First Embodiment

Figure 1:
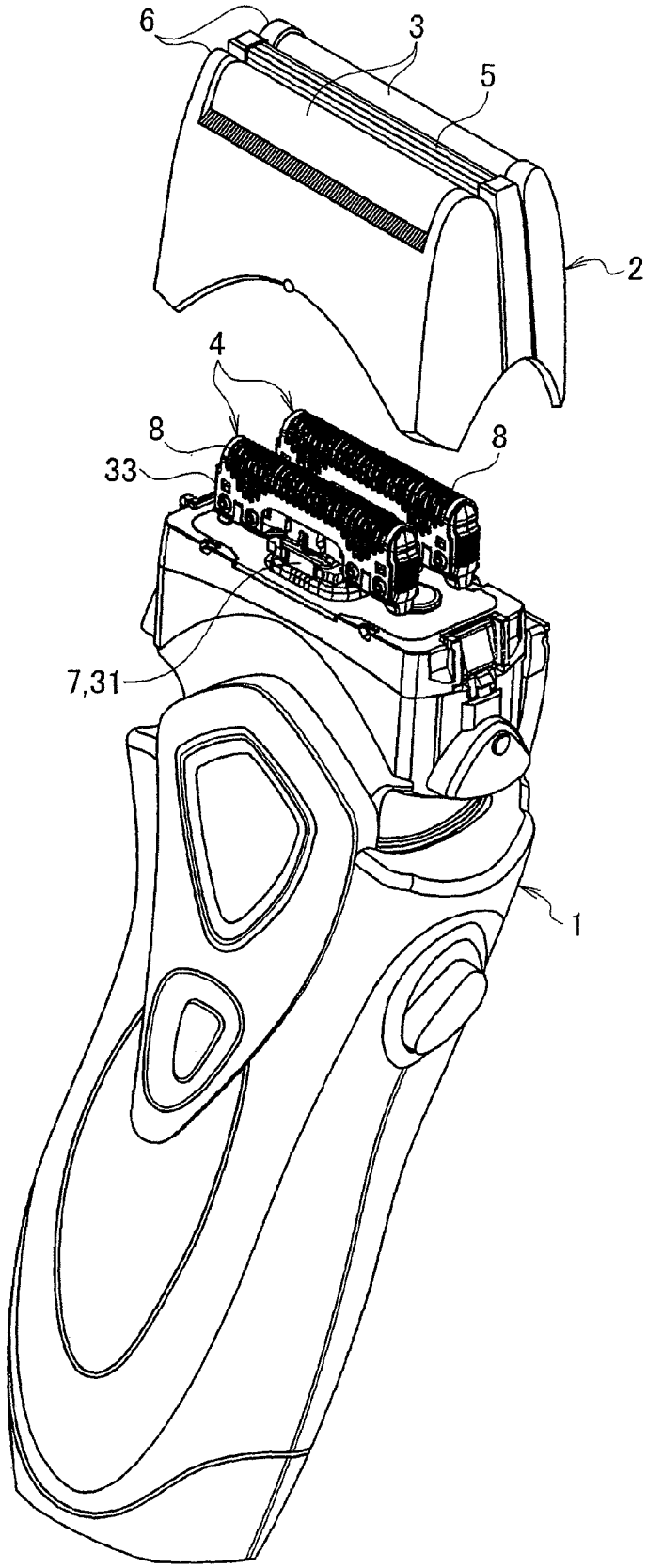
FIG. 1 is an exploded perspective view showing an electric shaver according to a first embodiment of the present invention.
Figure 2:
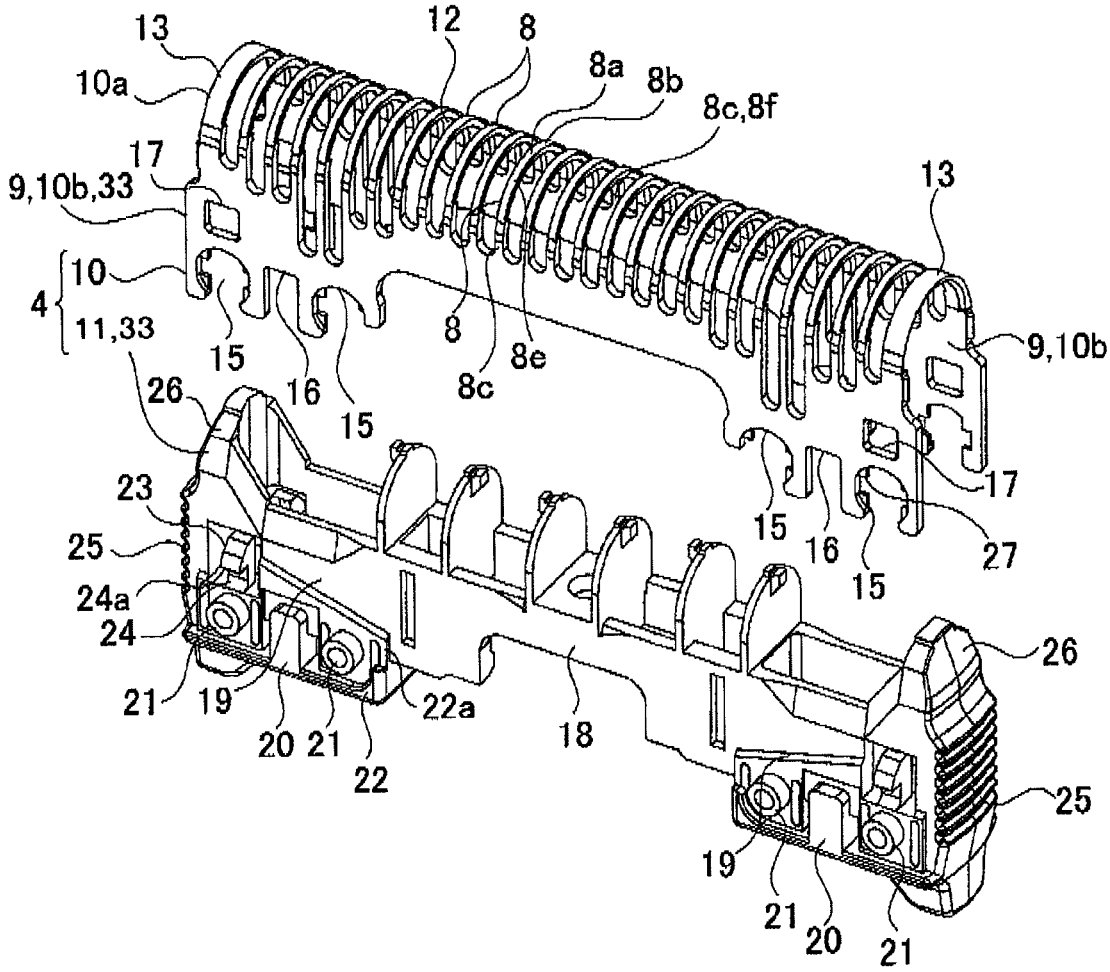
FIG. 2 is an exploded perspective view showing an inner cutter according to the first embodiment.
Figure 3:
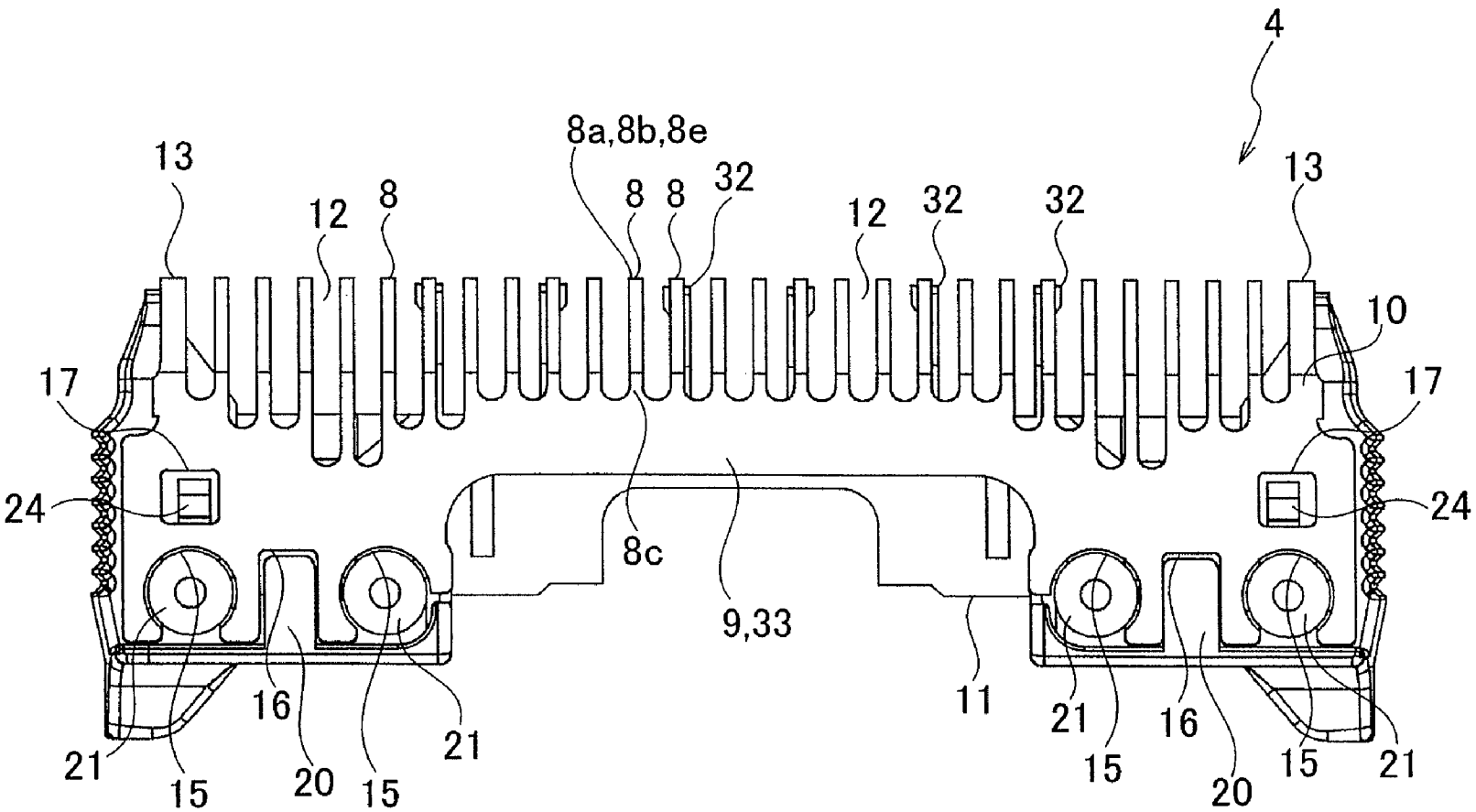
FIG. 3 is a front view of the inner cutter according to the first embodiment.
Figure 4:
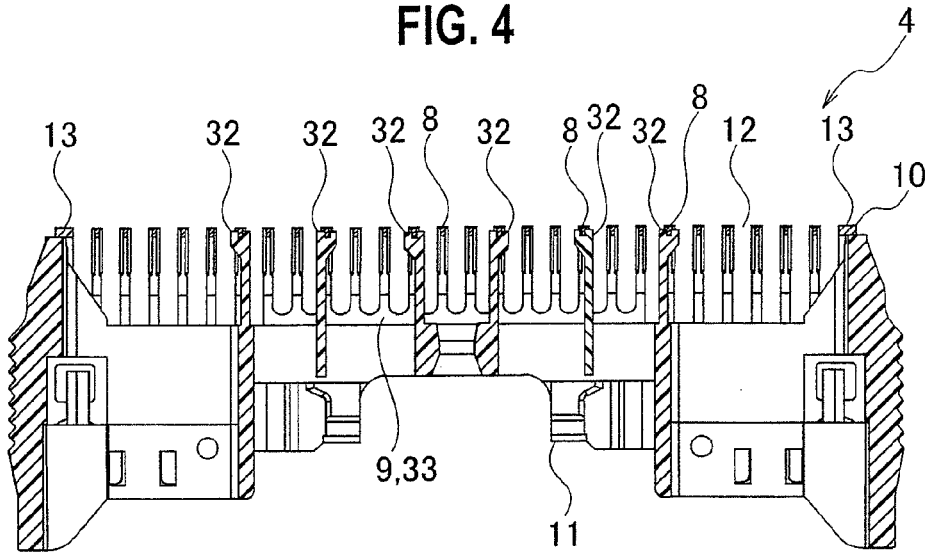
FIG. 4 is a longitudinal front view of the inner cutter according to the first embodiment.
Figure 5:
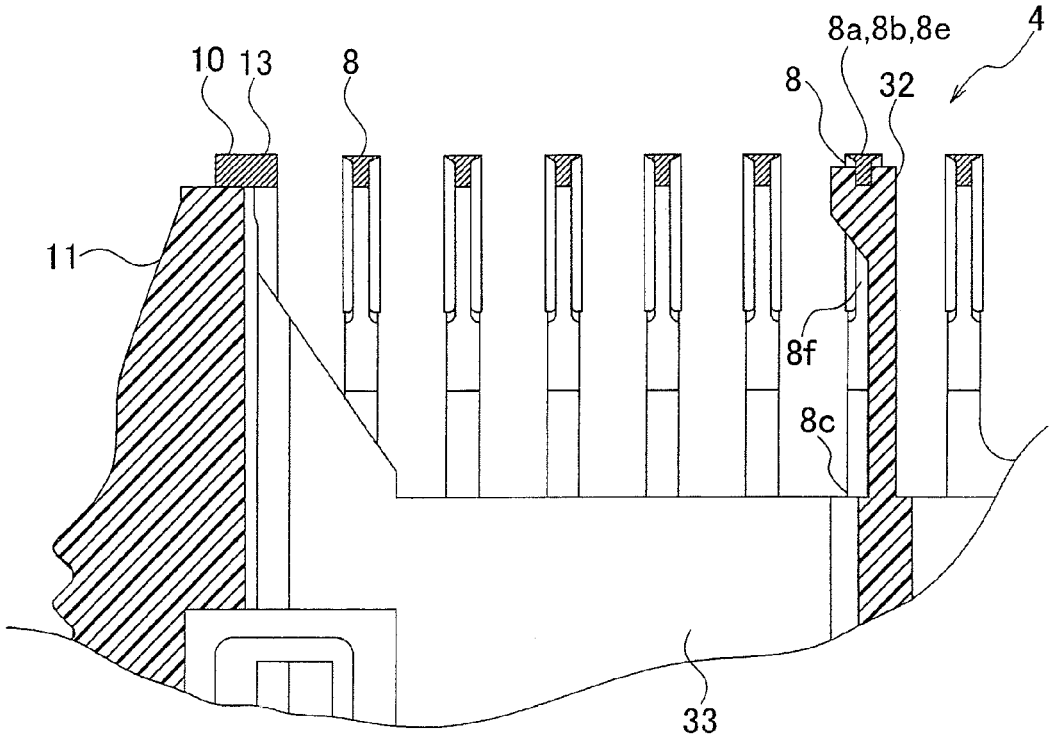
FIG. 5 is an enlarged longitudinal front view showing a part of the inner cutter according to the first embodiment.
Figure 6:
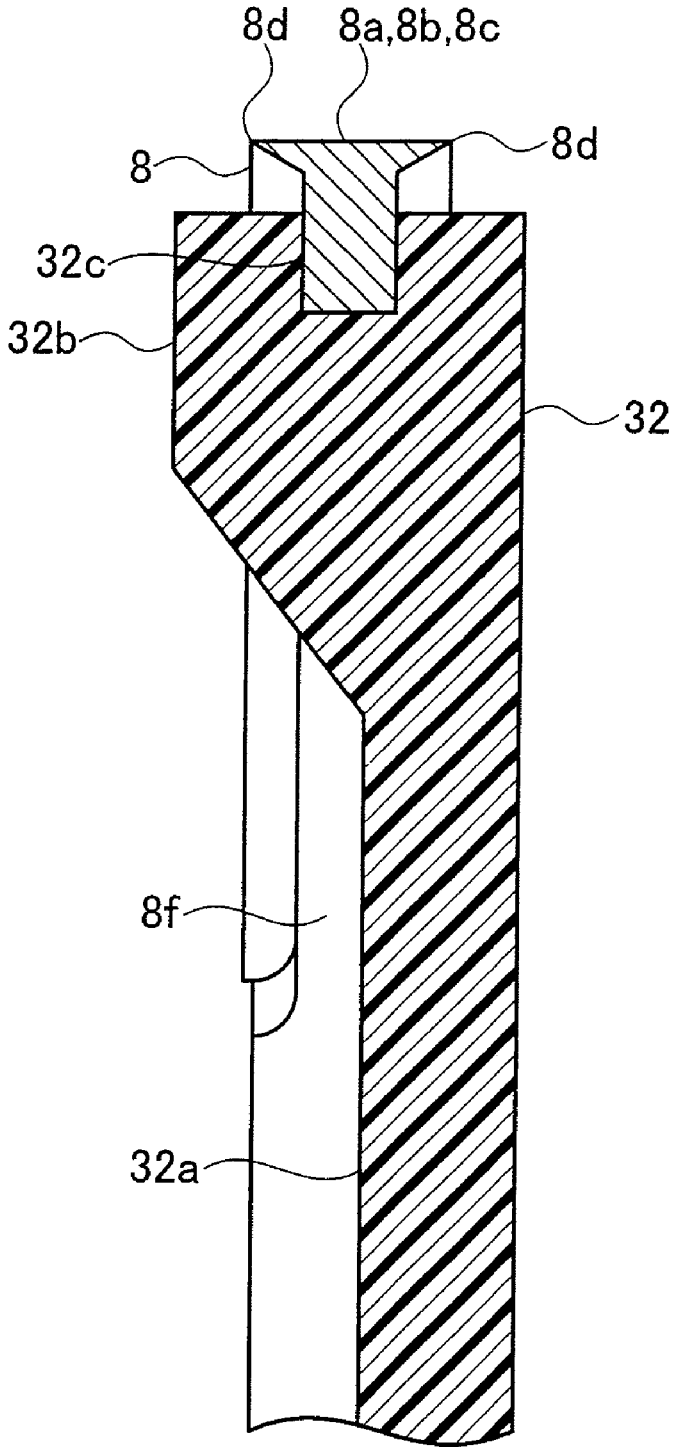
FIG. 6 is a longitudinal front view showing a cutting piece of the inner cutter and plate members according to the first embodiment.
Figure 7:
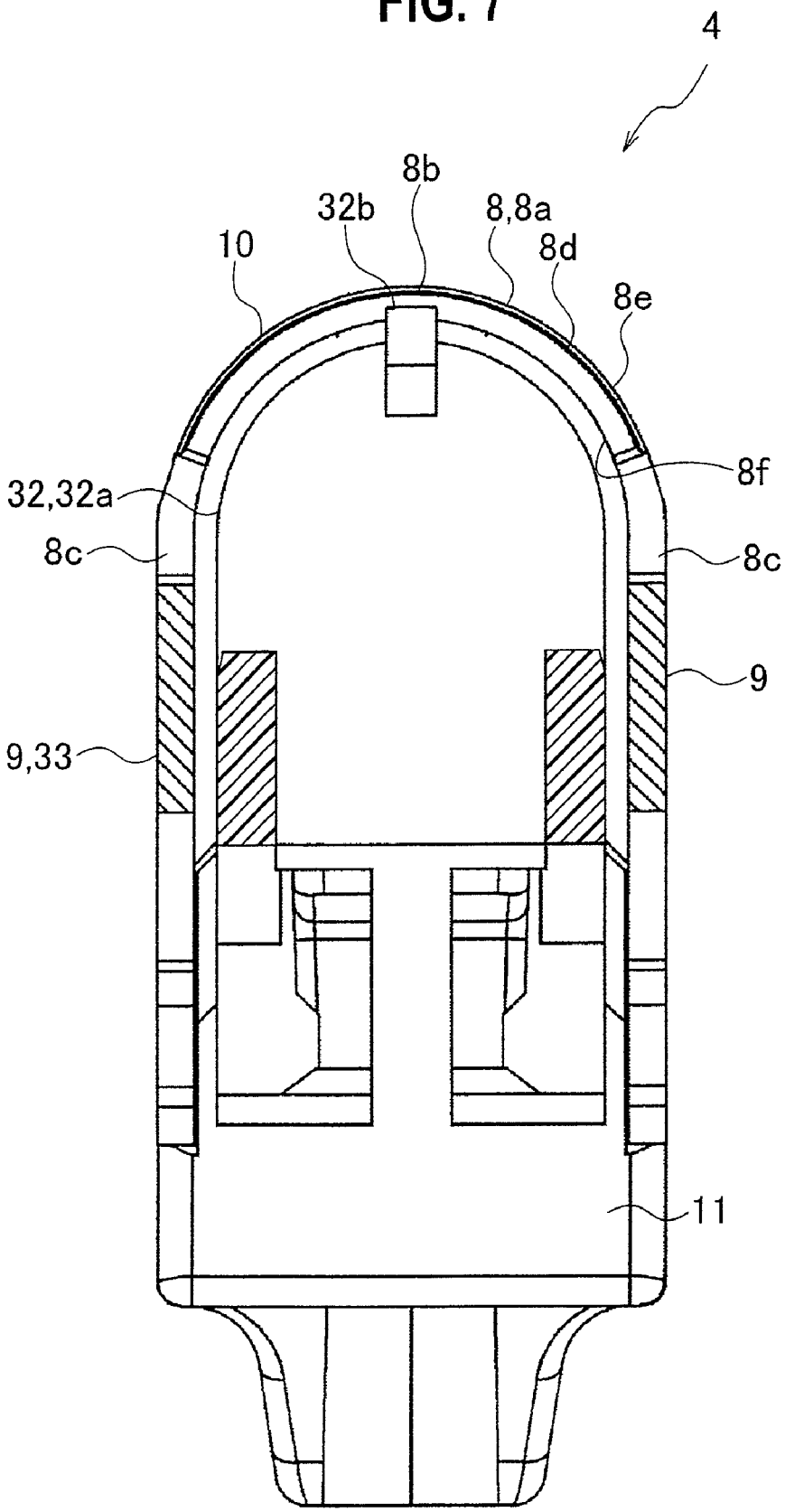
FIG. 7 is a longitudinal side view of the inner cutter according to the first embodiment.

A first embodiment of the present invention is explained with reference to FIG. 1 to FIG. 8. FIG. 1 is an exploded perspective view showing an electric shaver according to the present embodiment, FIG. 2 is an exploded perspective view showing an inner cutter, FIG. 3 is a front view of the inner cutter, FIG. 4 is a longitudinal front view of the inner cutter, FIG. 5 is an enlarged longitudinal front view showing apart of the inner cutter, FIG. 6 is a longitudinal front view showing a cutting piece of the inner cutter and plate members 32, and FIG. 7 is a longitudinal side view of the inner cutter.

As shown in FIG. 1, a reciprocating electric shaver includes a main unit 1 and an outer cutter cassette 2 that is connected at the upper end of the main unit 1. In the outer cutter cassette 2, a slit cutter cassette 5 for rough cutting is arranged at a central part thereof and net cutter cassettes 6 are arranged on both sides of the slit cutter cassette 5.

At an upper end of the main unit 1, a pair of drivers 7 protrudes. A pair of inner cutters 4 of the electric shaver (hereinafter, simply "inner cutter") that is detachably attached to the drivers 7 are reciprocated integrally with the drivers 7 that are driven by a motor (not shown). In the state where the outer cutter cassette 2 is set on the main unit 1, the inner cutters 4 respectively slide along inner surfaces of outer cutters 3 that are arranged at the upper end of the corresponding net cutter cassettes 6 in reciprocation. This reciprocating electric shaver cuts hairs such as beard that enter through cutter holes (not shown) of the outer cutters 3 by sandwiching with edge portions of the cutter holes of the outer cutters 3 and a plurality of cutting pieces 8 provided in the inner cutters 4. The drivers 7 constitute a driving unit 31 together with the motor.

The structure of the inner cutter 4 is explained in detail. As shown in FIGS. 2 to 5, the inner cutter 4 includes an inner cutter unit 10 that includes a plurality of cutting pieces 8 formed thin and in a U-shape and a pair of supporting walls 9 that connects bottom ends of the cutting pieces 8, and a joint member 11 that is detachably connected to the driver 7 in the driving unit 31 and that is reciprocated by the driver 7. The inner cutter unit 10 and the joint member 11 are fixed to each other in the state where the inner cutter unit 10 is fit onto the joint member 11, and the plate members 32 formed with resin are put on the joint member 11 and the cutting pieces 8. Thus, the inner cutter 4 is structured. The cutting pieces 8 are arranged such that a top portion 8*b* (hereinafter, "curvature top portion 8*b*") of a curved portion 8*a* thereof is positioned top, both ends in the longitudinal direction are positioned bottom, and an outer surface 8*e* thereof contacts the inner surface of the outer cutter 3. The curved portion 8*a* cuts hairs by sandwiching with the edges of the cutter holes.

The inner cutter unit 10 is formed by bending a metal plate into an arch by a press. In the inner cutter unit 10, the multiple cutting pieces 8 in a U-shape are arranged in a row by forming a plurality of slit holes 12 in an upper portion 10*a* having a convex substantially-arc-shaped section. Moreover, in the inner cutter unit 10, a lower portion 10*b* that is a portion extended downward respectively from both bottom ends of the upper portion 10*a* serves as a pair of the supporting walls 9. In other words, both ends 8*c* of the cutting pieces 8 are fixed to a pair of the supporting walls 9.

In the present embodiment, the direction in which the cutting pieces 8 are arranged in a row (in other words, the direction in which the inner cutters 4 slide in reciprocation) is referred to as a right and left direction, and the direction perpendicular to the right and left direction and an up and down direction is referred to as a front and rear direction.

As shown in FIG. 6, right and left ends of the cutting piece 8 is gouged so that upper portion thereof forms sharp edges 8*d* that are pointed in the right and left direction, and thickness in the right and left direction (sliding direction) of the curvature top portion 8*b* of the cutting piece 8 at the outer circumference is thicker than thickness in the right and left direction (sliding direction) of the curvature upper portion at the inner circumference. Furthermore, as shown in FIGS. 2 and 3, by forming both ends in the longitudinal direction of the slit holes 12 in a substantially arc shape, strength at the connected portion between the cutting pieces 8 and the supporting wall 9 is secured, thereby ensuring rigidity of the cutting pieces 8.

On both sides of the cutting pieces 8 arranged in a row in the right and left direction, guard pieces 13 that are wider than the cutting pieces 8 are arranged. The guard pieces 13 are formed in a U-shape similarly to the cutting pieces 8, and both ends in the longitudinal direction are integrally supported by a pair of the supporting walls 9. By being arranged at both ends, the guard pieces 13 connect the entire inner cutter unit 10 robustly so that the cutting pieces 8 are not damaged by an external shock.

In each of the supporting walls 9, a rectangular concave portion 16 that opens downward in a substantially rectangular shape is provided at a central part in the right and left direction. On both sides of each rectangular concave portion 16, circular concave portions 15 that open downward in a substantially circle shape are provided. From the inner circumference of the circular concave portion 15, a plurality of thin convex portions 27 project inwardly. Moreover, above the circular concave portion 15 positioned at the outer side of a pair of the circular concave portions 15 corresponding to each of the rectangular concave portions 16, a rectangular window 17 in a form of rectangular hole is provided at substantially center of the supporting wall 9 in the up and down direction.

The joint member 11 is long in the right and left direction within such length that can almost be housed inside the inner cutter unit 10. The joint member 11 is constituted of a main unit attaching portion 18 and inner cutter fixing portions 19 positioned both sides of the main unit attaching portion 18. The joint member 11 is formed with resin. In the joint member 11, rectangular convex portions 20 formed in a rectangular pillar shape project downward at a central part on both surfaces respectively facing front and rear. Furthermore, in the joint member 11, on the right and left sides thereof, heat seal bosses 21 in a cylindrical shape project. Above the heat seal boss 21 positioned away from the main unit attaching portion 18 of a pair of the heat seal bosses 21, a hollow portion 23 is formed. In addition, above this heat seal boss 21, a connecting hook 24 having a hook portion 24*a* is provided. A part of the hook portion 24*a* projects out from the hollow portion 23. In the upper end portions at right and left ends of the joint member 11, finger placing portions 25 as a portion picked at the time of attaching and detaching the inner cutter 4 to and from the main unit 1 are provided. From the upper portion of each of the finger placing portions 25, a protrusion 26 is extended above. A base portion 33 comprises the joint member 11 and a pair of the supporting walls 9 of the inner cutters 4.

Furthermore, on the upper surface of the joint member 11, the plate members 32 are integrally formed so as to project from the upper surface of the joint member 11. The plate member 32 includes a plate main body 32*a* and a cutting piece connecting portion 32*b* that is continuously provided at the upper end thereof. The plate members 32 are arranged in plurality (in the present embodiment, six pieces) keeping an interval between each other so as to be positioned under the cutting pieces 8 of the inner cutter unit 10. As shown in FIG. 4, the plate members 32 are arranged keeping an interval corresponding to a space between two alternate cutting pieces 8 or larger.

As shown in FIG. 7, the side surface of the plate main body 32*a* has a similar shape as an inner rim of the side surface of the cutting piece 8 and has an arc shape at the upper portion. It is structured to keep a space between this plate main body 32*a* and an inner surface 8*f* of the cutting piece 8.

The upper end of the cutting piece connecting portion 32*b* is positioned closer to the inner circumference of the cutting edge 8 than an outer surface 8*e* of the curvature top portion 8*b* of the cutting piece 8. Specifically, a distance between the outer surface 8*e* of the cutting piece 8 and the cutting piece connecting portion 32*b* is 0.05 mm or more. Thickness in the right and left direction of the upper portion of the cutting piece connecting portion 32*b* is thicker than thickness in the right and left direction of the curvature top portion 8*b* and the plate main body 32*a*, and the lower portion of the cutting piece connecting portion 32*b* is tapered such that thickness of the bottom end thereof becomes the same thickness as that of the plate main body 32*a*. With this structure, in the plate member 32, thickness of the bottom end is thinner than thickness of the upper end.

As shown in FIGS. 2 to 7, at the upper portion of this cutting piece connecting portion 32*b*, a groove 32*c* is provided that engages with the inner circumference portion (bottom end) of the curvature top portion 8*b* of the cutting piece 8. In other words, the plate member 32 is supported with the base portion 33 (supporting wall 9) at the bottom end, and with the curved portion 8*a* of the cutting piece 8 at the upper end. In this structure, the upper end of the plate member 32 and the curvature top portion 8*b* of the cutting piece 8 overlap with each other in the right and left direction (sliding direction). With such a supporting structure, while the plate member 32 engages with the cutting piece 8 in the right and left direction, the plate member 32 is connected to enable relative movement along an inside-outside direction (up and down direction) of the curvature top portion 8*b* of the cutting piece 8, and the plate member 32 is elastically deformed corresponding to elastic deformation of the cutting piece 8.

Furthermore, the position at which the bottom end of the plate member 32 and the base portion 33 (supporting wall 9) are fixed and the position at which the upper end of the plate member 32 and the cutting piece 8 are connected are shifted along the right and left direction (sliding direction). Moreover, rigidity of the plate member 32 is lower than rigidity of the cutting piece 8.

A connecting structure of the inner cutter unit 10 and the joint member 11 structured as above is explained. The inner cutter unit 10 and the joint member 11 are connected by heat sealing the heat seal boss 21 of the joint member 11 in such a state that the heat seal boss 21 is engaged in the circular concave portion 15 of the inner cutter unit 10. The bottom surface of the hook portion 24*a* of the connecting hook 24 of the joint member 11 is locked at the lower inner side surface of the rectangular window 17 of the inner cutter unit 10, thereby preventing the inner cutter unit 10 from escaping upward from the joint member 11. Furthermore, the rectangular convex portion 20 of the joint member 11 engages in the rectangular concave portion 16 in a pair of the supporting wall 9, thereby positioning the inner cutter unit 10 with respect to the joint member 11 in the right and left direction. Moreover, convex surfaces 22*a* of contact convex portions 22 formed on a front surface and a rear surface contacts inner surfaces of the supporting walls 9 of the inner cutter unit 10, thereby achieving positioning in the front and rear direction.

In such a structure, when hairs that have entered through the cutting holes of the outer cutter 3 are cut by sandwiching with the edges of the cutting holes and the curved portion 8*a* of the cutting pieces 8 of the inner cutters 4 that are slid in reciprocation along the inner surface of the outer cutter 3, the cutting pieces 8 are bent (elastically deformed) due to contact with the hairs that have entered through the cutting holes. At the time of cutting the hairs, the bend of the cutting pieces 8 are released (recovered) and the cutting pieces 8 vibrate to make the shaving sound. At this time, in the present embodiment, the plate member 32 whose bottom end is fixed to the base portion 33 and whose upper end is connected to the cutting piece 8 is elastically deformed corresponding to the elastic deformation of the cutting piece 8 to vibrate in a similar manner as the cutting piece 8. Therefore, compared to the case where the plate member is supported in the cantilever structure, the plate member 32 can vibrate more air. As a result, it is possible to make the shaving sound significantly louder and to realize comfortable shaving for users.

Moreover, in the present embodiment, as described above, the upper end of the plate member 32 and the curvature top portion 8*b* of the cutting piece 8 overlap with each other in the right and left direction (sliding direction). Therefore, even if the cutting piece 8 is bent much in the sliding direction, connection between the cutting piece 8 and the plate member 32 can be maintained, thereby securing reliability in connection between the cutting piece 8 and the plate member 32.

Furthermore, in the present embodiment, as described above, a distance between the outer surface 8*e* of the cutting piece 8 and the cutting piece connecting portion 32*b* is 0.05 mm or more. Therefore, the upper end of the plate member 32 does not disturb cutting hairs at the upper edges of the cutting piece 8, thereby ensuring cutting sharpness.

Moreover, in the present embodiment, as described above, rigidity of the plate member 32 is lower than rigidity of the cutting piece 8. Therefore, the plate member 32 is easily bent compare to the structure where the rigidity of the plate member is higher than the rigidity of the cutting piece 8. Therefore, it is possible to make increase in rigidity of the cutting piece 8 to which the plate member 32 is connected small, and to increase a bend amount of the cutting piece 8. Accordingly, the shaving sound can be certainly made louder.

Furthermore, in the present embodiment, as described above, the plate member 32 is formed such that the bottom end is thinner than the upper end. Therefore, the plate member 32 is easily bent as a whole. Accordingly, vibration volume increases, thereby making the shaving sound louder.

Moreover, in the present embodiment, as described above, the plate member 32 and the cutting piece 8 are arranged so as to enable relative movement along an inside-outside direction (up and down direction) of the curvature top portion 8*b* of the cutting piece 8. Therefore, it is possible to keep the increase in rigidity of the cutting piece 8 caused by connection with the plate member 32 small. Therefore, the movement of the cutting piece 8 can be made smooth. Accordingly, the shaving sound can be certainly made louder while keeping sharpness of the cutting piece 8.

Furthermore, in the present embodiment, as described above, the plate member 32 is formed with resin. Therefore, the rigidity of the plate member 32 can be kept low compared to the case where the plate member 32 is formed with steel. Therefore, the plate member 32 can be structured to bend easily, and the shaving sound can be certainly made louder.

Moreover, in the present embodiment, as described above, the plate member 32 is connected to the inner circumference of the curvature top portion 8*b* of the cutting piece 8, and thickness in the right and left direction of the curvature top portion 8*b* of the cutting piece 8 at the outer circumference is thicker than thickness in the right and left direction of the curvature upper portion 8*b* at the inner circumference of the curvature top portion 8*b*. Therefore, a projecting amount of the plate member 32 with respect to the cutting piece 8 in the right and left direction can be made small, thereby ensuring the cutting sharpness at the curvature top portion 8*b* of the cutting piece 8.

Furthermore, in the present embodiment, as described above, the position at which the bottom end of the plate member 32 and the base portion 33 are fixed and the position at which the upper end of the plate member 32 and the cutting piece 8 are connected are shifted in the right and left direction. Therefore, even when a shock is applied on the inner cutter 4 of the electric shaver due to, for example, a fall and the curved portion 8*a* of the cutting piece 8 is deformed in the direction of flattening the curvature, the plate member 32 flexibly bends. Therefore, it is possible to suppress an impact force on the cutting piece 8 to suppress the damage of the cutting piece 8.

Moreover, in the present embodiment, as described above, the plate member 32 is not arranged for each of the cutting pieces 8, and the plate members 32 are arranged keeping an interval corresponding to a space between two alternate cutting pieces 8 or larger. Thus, a sufficient space is kept between the plate members 32. Therefore, fewer cut hairs are collected between the plate members 32. In addition, between the plate members 32, through holes that open through the up and down direction are provided so that cut hairs fall down through the through holes. Therefore, fewer hairs are collected around the plate members 32.

Furthermore, in the present embodiment, as described above, the plate members 32 and the joint member 11 are integrally formed with resin. Therefore, it is possible to simplify the structure and to process easily at a low cost, to realize the inner cutter 4 that can cut cleanly and can make large shaving sound.

Figure 8:
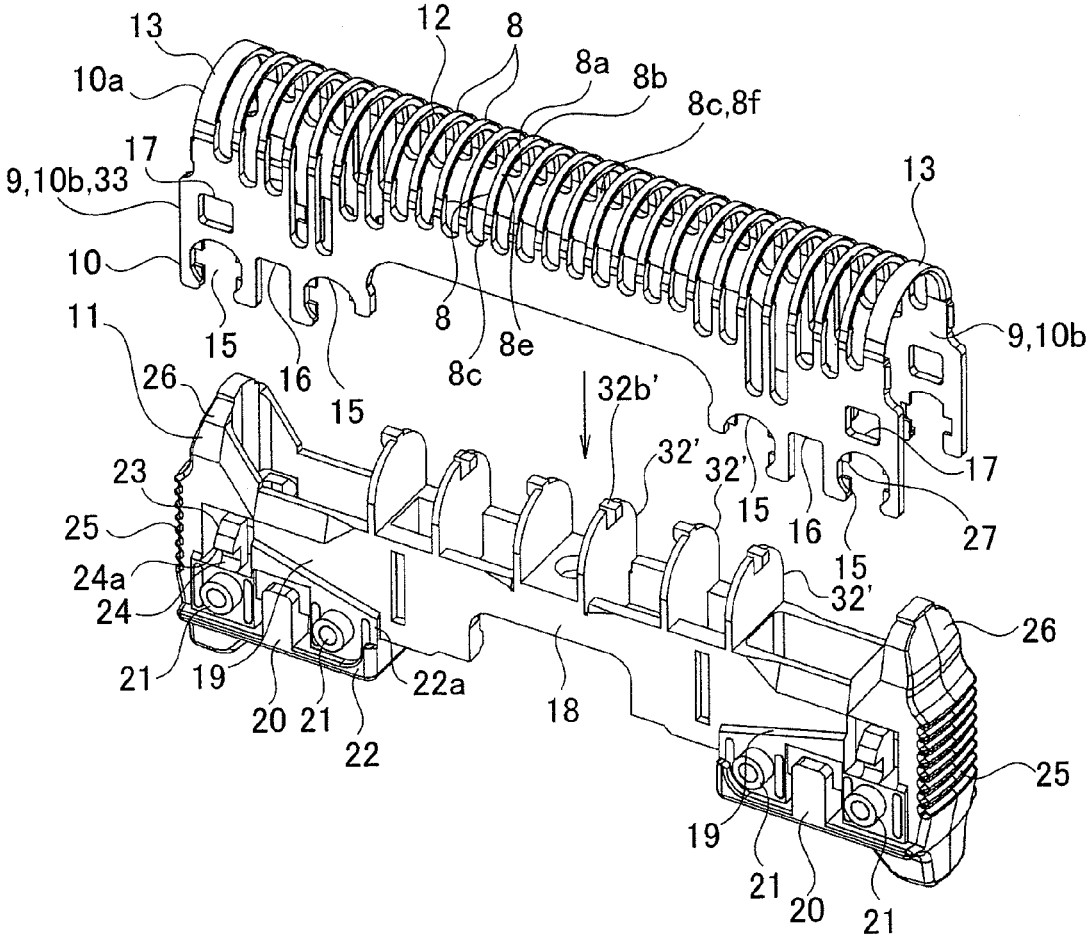
FIG. 8 is a perspective view showing the inner cutter according to the first embodiment at halfway of a manufacturing process.

A manufacturing method of the groove 32*c* of the plate member 32 is explained. FIG. 8 is a perspective view showing the inner cutter 4 at halfway of a manufacturing process. In the present embodiment, the groove 32*c* of the plate member 32 is formed at the time of connecting the plate member 32 and the cutting pieces 8. Specifically, as shown in FIG. 8, the inner cutter unit 10 is fit onto the joint member 11 in which a plate member 32' before formation of the groove 32*c* is integrally formed to position the joint member 11 inside the inner cutter unit 10, and the inner cutter unit 10 is moved downward until the inner cutter unit 10 contacts the joint member 11. It is structured such that the upper end of the plate member 32' is positioned above the bottom end of the curvature top portion 8*b* of the cutting piece 8 in the state where fixing of the inner cutter unit 10 and the joint member 11 is completed. Therefore, when the inner cutter unit 10 is moved downward, before the bottom end of the guard piece 13 contacts the upper end of the protrusion 26 of the joint member 11, the upper end of the plate member 32' contacts the bottom end of the curvature top portion 8*b* of the cutting piece 8.

While heating the cutting piece connecting portion 32*b'* by transmission of heat to the cutting piece connecting portion 32*b'* by heating the curvature top portion 8*b* of the cutting piece 8 with a heater (not shown), the inner cutter unit 10 is further moved downward until the upper end of the protrusion 26 of the joint member 11 contacts the bottom end of the gourd piece 13 to achieve the positioning of the inner cutter unit 10 and the joint member 11 in the up and down direction. Thus, the upper end of the plate member 32' is pressed to the cutting piece 8.

At this time, the cutting piece connecting portion 32*b'* of the plate member 32' is thermally deformed by being pressed by the bottom end of the cutting piece 8 in the heated state, and the upper end of the plate member 32' bites into the curvature top portion 8*b* of the cutting piece 8. Thus, the groove 32*c* is formed in the cutting piece connecting portion 32*b*, and the upper end of the plate member 32 and the curvature top portion 8*b* of the cutting piece 8 overlap with each other in the right and left direction as shown in FIG. 2.

As described above, in the present embodiment, the upper end of the plate member 32 is pressed relative to the cutting piece 8 while being heated to form the groove 32*c*. Therefore, even if the pitch of the cutting pieces 8 and the pitch of the plate members 32 relatively vary, the variation can be absorbed. Accordingly, the cutting pieces 8 and the plate members 32 can easily be connected to each other. Moreover, it is possible to surely form the state in which all of the plate members 32 are overlapped with the cutting pieces 8 without applying a twist or modification to the cutting pieces 8.

Second Embodiment

Figure 9:
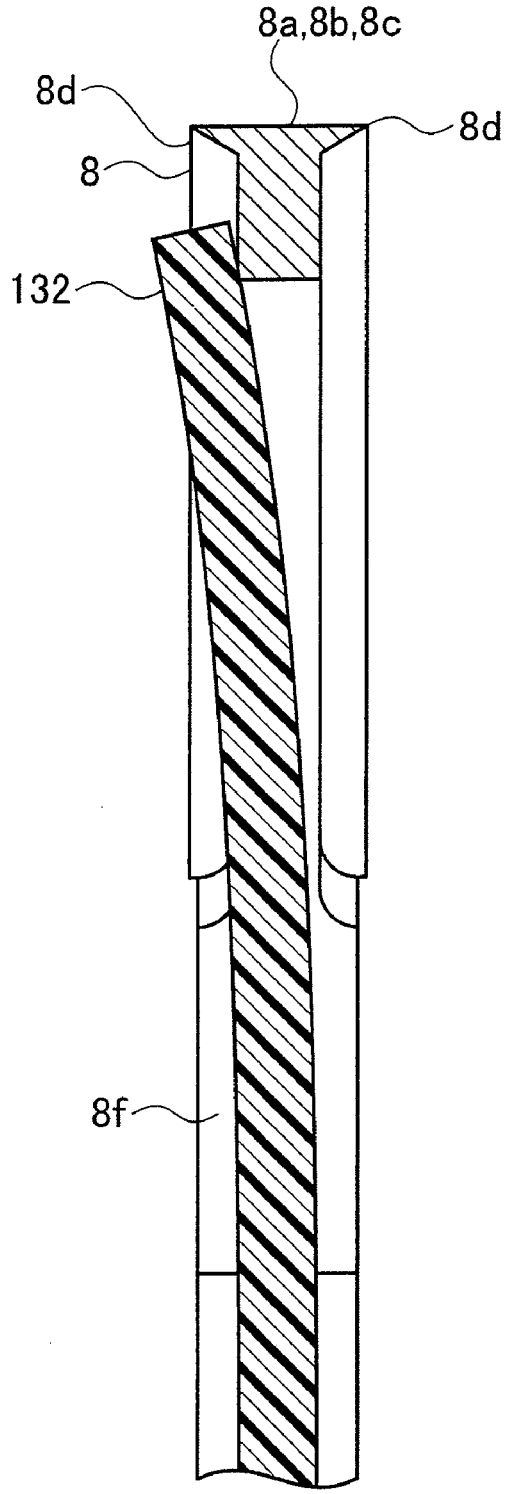
FIG. 9 is a longitudinal front view showing a cutting piece of an inner cutter and a plate member according to a second embodiment of the present invention.

A second embodiment of the present invention is explained with reference to FIG. 9. The same parts as the embodiment described above are referred by like reference numerals and explanations thereof will be omitted (same applies to following embodiments). FIG. 9 is a longitudinal front view showing a cutting piece of an inner cutter and a plate member according to the present embodiment.

The present embodiment differs from the first embodiment in the connecting structure of a plate member 132 and the cutting piece 8. Specifically, in the present embodiment, by pressing the upper end of the plate member 132 to the curvature top portion 8*b* from one side by a restoring force of the plate member 132 that has been bent, the other end of the plate member 132 is connected to the cutting piece 8.

With this structure, the plate member 132 is engaged with the cutting piece 8 in the right and left directions, and is connected so as to enable relative movement in the up and down directions. Thus, also in the present embodiment, the plate member 132 is elastically deformed corresponding to the elastic deformation of the cutting piece 8, and vibrates in a similar manner as the cutting piece 8. Therefore, compared to the case where the plate member is supported in the cantilever structure, the plate member 32 can vibrate more air. As a result, the shaving sound is made significantly louder.

Moreover, with this structure, the inner cutter 4 can be structured simply, and the number of assembly process of the plate members 132 and the cutting pieces 8 at the manufacturing can be reduced, as compared to the case where the plate members 132 are bonded to the cutting pieces 8.

Third Embodiment

Figure 10:
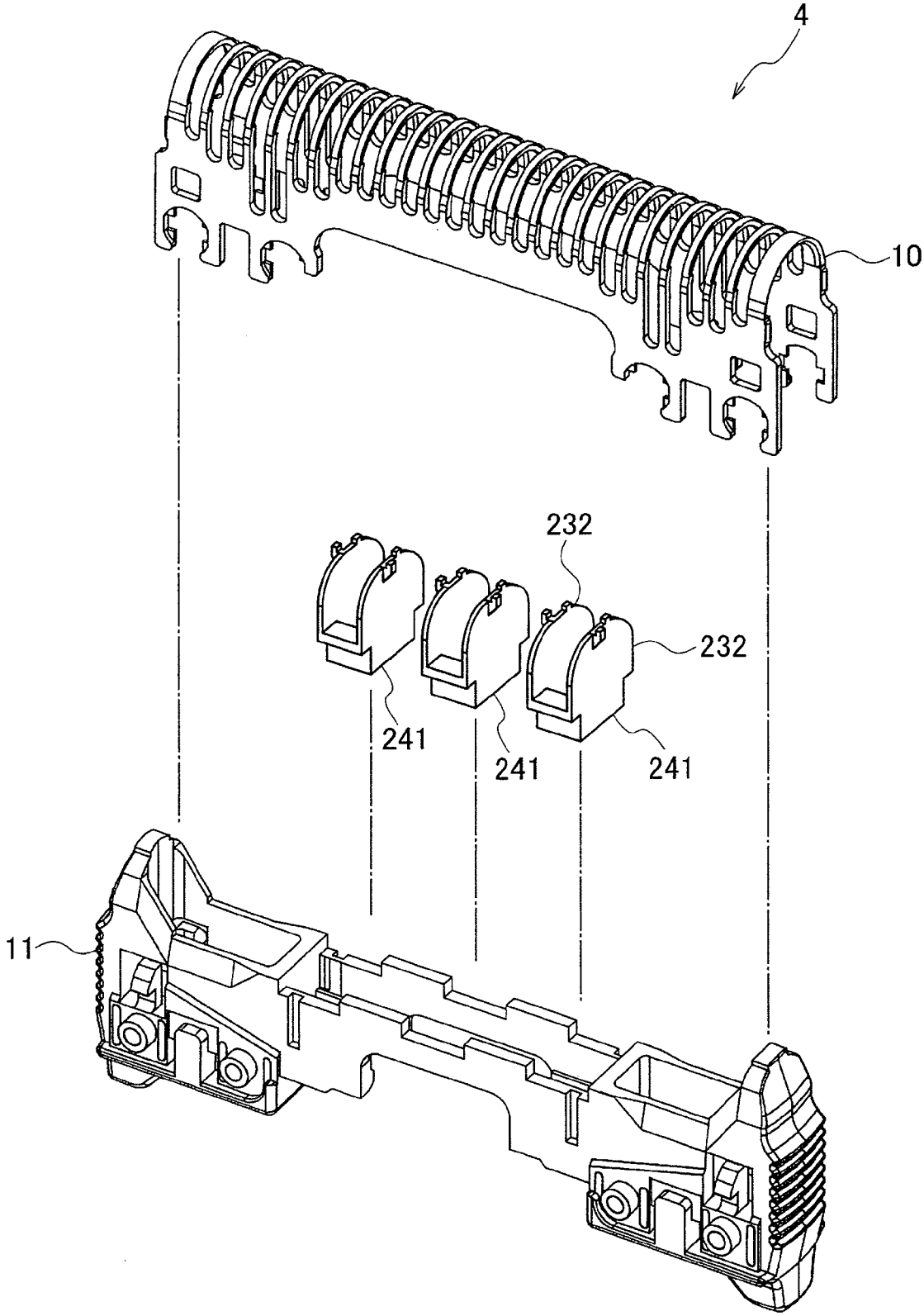
FIG. 10 is an exploded perspective view showing an inner cutter according to a third embodiment of the present invention.
Figure 11:
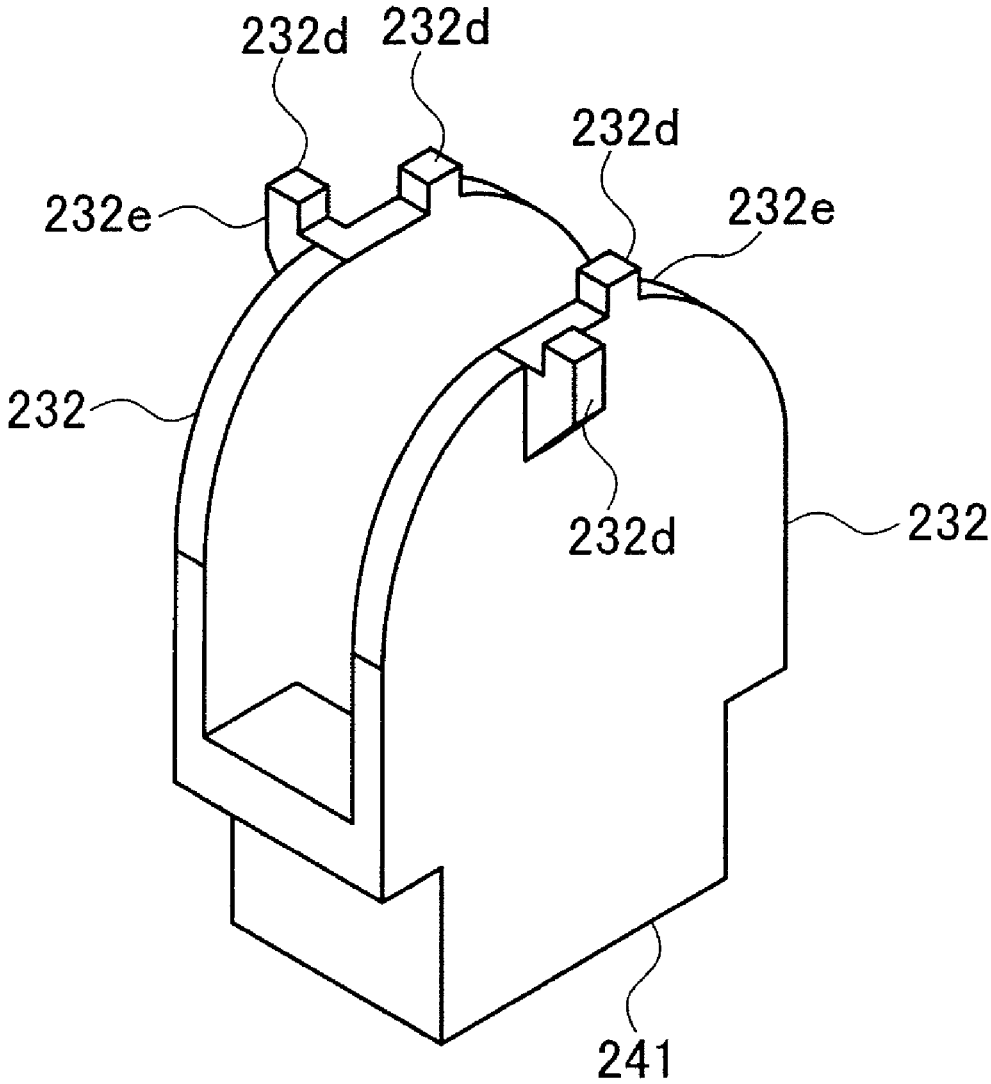
FIG. 11 is a perspective view showing a plate unit according to the third embodiment.

A third embodiment of the present invention is explained with reference to FIGS. 10 and 11. FIG. 10 is an exploded perspective view showing an inner cutter according to the present embodiment, and FIG. 11 is a perspective view showing a plate unit.

The present embodiment differs from the first embodiment in the connecting structure of a plate member 232 and the inner cutter 4. Specifically, a right and left pair of protruding pieces 232*d* are provided at the upper end of the plate member 232 at positions shifted from each other in the longitudinal direction of the cutting piece 8, to form an engaging portion 232*e*. With this engaging portion 232*e*, the curvature top portion 8*b* of the cutting piece 8 is sandwiched. With this structure, the plate member 232 is engaged with the cutting piece 8 in the right and left direction, and is connected to enable relative movement in the up and down direction. The engaging portion 232*e* is formed in advance prior to the connection of the plate member 232 and the cutting piece 8.

Moreover, in the present embodiment, a plurality of (in this embodiment, three units) the plate units 241 in which two pieces of the plate members 232 are integrally formed are provided separately from the joint member 11, and it is structured such that the plate units 241 are fixed to the joint member 11 by engagement.

With this structure, also in the present embodiment, the plate member 232 is elastically deformed corresponding to the elastic deformation of the cutting piece 8, and vibrates in a similar manner as the cutting piece 8. Therefore, compared to the case where the plate member is supported in the cantilever structure, the plate member 32 can vibrate more air. As a result, it is possible to make the shaving sound significantly louder.

Furthermore, in the present embodiment, the plate member 232 and the cutting piece 8 are connected by engaging the engaging portion 232*e*, which is formed in advance, with the cutting piece 8. Therefore, the number of assembly process of the plate members 232 and the cutting pieces 8 at the manufacturing can be reduced compared to, for example, the case where the plate members 232 are bonded to the cutting pieces 8.

Fourth Embodiment

Figure 12:
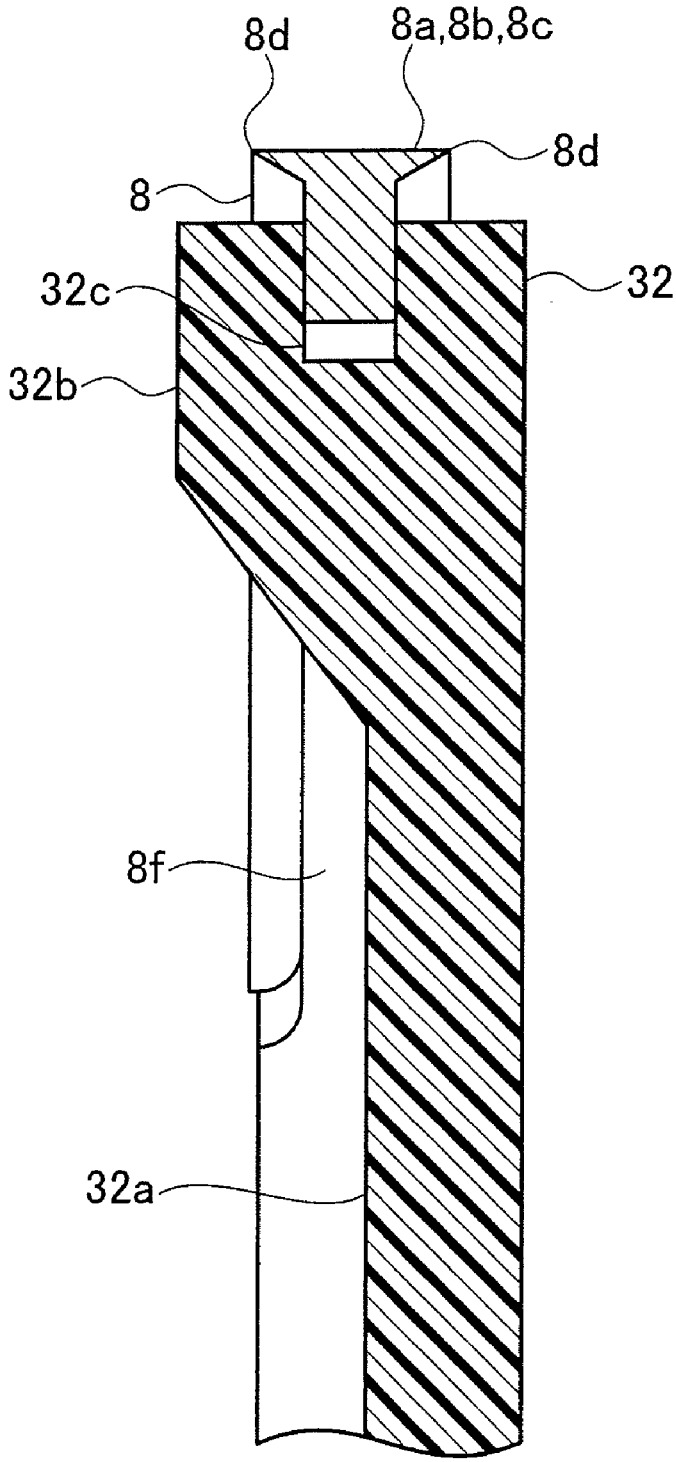
FIG. 12 is a longitudinal front view showing a cutting piece of an inner cutter and a plate member according to a fourth embodiment of the present invention.
Figure 13:
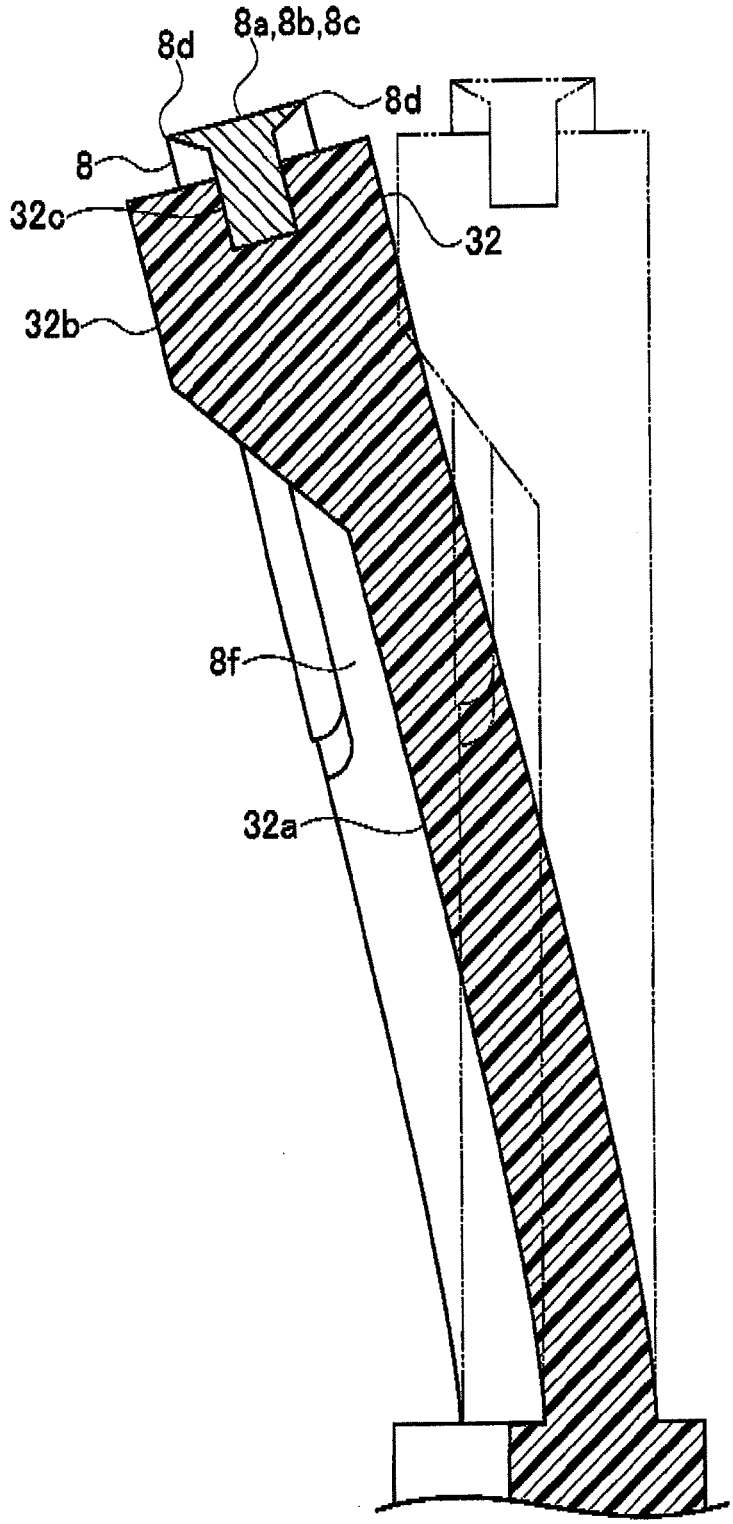
FIG. 13 is longitudinal front view show a cutting piece of the inner cutter and plate members according to the first embodiment, showing elastic deformation of the cutting piece and the plate member.

A fourth embodiment of the present invention is explained with reference to FIG. 12. FIG. 12 is a longitudinal front view showing a cutting piece of an inner cutter and a plate member according to the fourth embodiment.

The present embodiment differs from the first embodiment in that a space is provided between the bottom surface of the groove 32*c* of the plate member 32 and the lower surface of the cutting piece 8. This groove 32*c* is formed in advance prior to the connection of the plate member 32 and the cutting piece 8.

With this structure, the error in the forms in the up and down direction thereof can be absorbed at the time of connecting the plate member 32 and the cutting piece 8. Therefore, the plate member 32 and the cutting piece 8 can be connected easily.

The present invention is not limited to the above embodiments, and other embodiments can be made without departing from the scope of the invention.

For example, the plate member and the cutting piece can be connected by bonding while the plate member and the cutting pieces are struck to each other. Thus, the relative variation in the pitch of the cutting piece and the pitch of the plate member can be absorbed. Therefore, it is possible to simplify the assembly work.

Furthermore, by opening a through hole in the right and left direction at a central part of the plate main body of the plate member, or by providing a groove that opens downward from the bottom end to the central part of the plate main body in the right and left direction, it is possible to make hairs less likely to be collected around the plate members.

Moreover, the bottom ends (both ends in the longitudinal direction) of the cutting piece and the bottom end of the plate member can be positioned at the same level.

What is claimed is:

1. An inner cutter of an electric shaver that cuts hairs by sliding along an inner surface of an outer cutter through which the hairs enter, comprising:

a joint member that is connected to a driving unit of the electric shaver;

a plurality of cutting pieces formed thin and long in a U-shape such that an outer surface of a cutting piece contacts an inner surface of the outer cutter, the plurality of cutting pieces having both ends fixed with respect to the joint member in a longitudinal direction thereof; and a plate member including a plate main body of a plate shape having a bottom end fixed to the joint member, and a cutting piece connecting portion continuously provided at an upper end of the plate main body and engaged with a cutting piece in a sliding direction of the cutting piece, wherein the plate member has a recess located on the cutting piece connecting portion of the plate member that is horizontally offset in the direction of sliding from a longitudinal axis of the plate main body, and wherein the cutting piece has a bottom portion with a rectangular cross section that is cooperatively shaped to fit within the recess of the plate member.

2. The inner cutter of an electric shaver according to claim 1, wherein the cutting piece connecting portion of the plate member and a curvature top portion of the cutting piece overlap with each other in a direction of sliding.

3. The inner cutter of an electric shaver according to claim 2, wherein the plate member is connected to an inner circumference portion of the curvature top portion of the cutting piece, and the cutting piece has a width in the direction of sliding at an outer circumference portion of the curvature top portion greater than a width in the direction of sliding at the inner circumference portion of the curvature top portion.

4. The inner cutter of an electric shaver according to claim 1, wherein rigidity of the plate member is lower than rigidity of the cutting piece.

5. The inner cutter of an electric shaver according to claim 1, wherein the plate member is formed such that a thickness at one end is thinner than a thickness at another end.

6. The inner cutter of an electric shaver according claim 1, wherein the plate member and the cutting piece are configured to enable relative movement along an inner-outer direction of the curvature top portion of the cutting piece.

7. The inner cutter of an electric shaver according to claim 1, wherein a space is provided between a bottom surface of the recess and the bottom portion of the cutting piece.

8. The inner cutter of an electric shaver according to claim 1, wherein the plate member is formed with resin.

9. The inner cutter of an electric shaver according to claim 1, wherein the cutting piece connecting portion of the plate member is connected to the cutting piece through physical contact and the plate member is elastically deformed corresponding to elastic deformation of the cutting piece by physically exchanging force with the cutting piece through physical contact with the cutting piece.

10. The inner cutter of an electric shaver according to claim 1, wherein the plate main body has an arc shaped side surface a side surface at an upper portion thereof, the arc shaped side surface having a shape similar to an inner rim of a side surface of the cutting piece, and the plate main body is solid.

11. A reciprocating electric shaver, comprising:

an outer cutter through which hairs enter;

an inner cutter that cuts hairs by sliding along an inner surface of the outer cutter, the inner cutter comprising:

a joint member that is connected to a driving unit of the reciprocating electric shaver;

a plurality of cutting pieces that are formed thin and long in a U-shape such that an outer surface of a cutting piece contacts an inner surface of the outer cutter, the plurality of cutting pieces having both ends fixed with respect to the joint member in a longitudinal direction thereof; and a plate member including a plate main body of a plate shape having a bottom end fixed to the joint member, and a cutting piece connecting portion continuously provided at an upper end of the plate main body and engaged with a cutting piece in a sliding direction of the cutting piece, wherein the driving unit reciprocates the inner cutter, wherein the plate member has a recess located on the cutting piece connecting portion of the plate member that is horizontally offset in the direction of sliding from a longitudinal axis of the plate main body, and wherein the cutting piece has a bottom portion with a rectangular cross section that is cooperatively shaped to fit within the recess of the plate member.

12. The reciprocating electric shaver according to claim 11, wherein the cutting piece connecting portion of the plate member is connected to the cutting piece through physical contact and the plate member is elastically deformed corresponding to elastic deformation of the cutting piece by physically exchanging force with the cutting piece through physical contact with the cutting piece.

13. The reciprocating electric shaver according to claim 11, wherein the plate main body has an arc shaped side surface at an upper portion thereof, the arc shaped side surface having a shape similar to an inner rim of a side surface of the cutting piece, and the plate main body is solid.

* * * * *